US007681515B1

(12) United States Patent
Apple

(10) Patent No.: US 7,681,515 B1
(45) Date of Patent: Mar. 23, 2010

(54) LIFE RAFT LAUNCHER

(75) Inventor: Thomas A. Apple, Suffolk, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 12/231,421

(22) Filed: Aug. 28, 2008

(51) Int. Cl.
*B63B 23/00* (2006.01)

(52) U.S. Cl. ..... 114/365; 182/48; 441/41; 441/42

(58) Field of Classification Search ..... 114/362, 114/365, 366, 367; 441/38, 41, 42; 182/48, 182/70
See application file for complete search history.

(56) References Cited

U.S. PATENT DOCUMENTS 3,827,094 A * 8/1974 Fisher ..... 441/38
3,860,984 A * 1/1975 Fisher ..... 441/41
3,910,532 A 10/1975 Fischer
3,952,350 A * 4/1976 Moucka ..... 441/41
4,031,583 A * 6/1977 Phillips, II ..... 114/362
4,633,802 A * 1/1987 Olsen ..... 114/367
5,102,070 A * 4/1992 Smialowicz et al. ..... 182/48
5,342,230 A 8/1994 Louis
5,630,740 A 5/1997 Lavorata
6,869,326 B2 * 3/2005 Richard ..... 441/42
7,467,764 B2 * 12/2008 Hintzman ..... 182/48

OTHER PUBLICATIONS

USS Zumwalt (DG-1000).

* cited by examiner

*Primary Examiner*—Lars A Olson
(74) *Attorney, Agent, or Firm*—Richard A. Morgan

(57) ABSTRACT

A life raft canister is launched from a below deck doorway. A launcher is activated and pneumatically opens a below deck door, exposing the doorway. The same inflation tank inflates an elongated bladder that forces the life boat canister out of the doorway. The canister drops to the sea where the life boat is deployed from the canister. The life raft auto-inflates. As a result, a life raft is deployed from below-deck.

20 Claims, 2 Drawing Sheets

LIFE RAFT LAUNCHER

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

1. Field of the Invention

The invention relates to ships. More particularly, the invention relates to a ship-board life raft handling apparatus. Most particularly, the invention relates to an apparatus for launching a life raft from below-deck.

2. Discussion of the Related Art

U.S. naval vessels carry life boats or life rafts for the emergency evacuation of the crew. Life boats and life rafts are stored on deck and lowered to the sea by means of davits. Because a life raft is uninflated for storage, it takes up less space than a life boat and is often the preferred evacuation vessel. A life raft is stored on deck in the uninflated and folded state in a life raft canister and then inflated immediately before use. A canister allows the life raft to be dropped from deck into the sea which eliminates the need for davits. The life raft is deployed from the canister when the sea painter connected to the inflation system is pulled, actuating inflation valves. Included in the canister is inflation means such as an inflation gas cylinder attached to the folded life raft. The life boat canister is periodically opened and inspected for integrity of the life raft and for gas pressure in the inflation gas cylinder.

U.S. naval vessels typically carry life rafts in preference to life boats. Smaller vessels carry 6 to 15 person life rafts. Standard Navy life rafts are the 25-person Mark 7 (Mk-7) and the 50-person Mark 8 (Mk-8). These life rafts are made of polyurethane coated nylon fabric and are stored with a gas inflation cylinder in a life boat canister. The canister is a hard fiber glass shell. The Mark 7 raft takes 550 cubic inches of gas to inflate from an inflation cylinder at a minimum test pressure of 4500 psi (pounds per square inch). The Mark 8 raft takes 1636 cubic inches of gas to inflate from two inflation cylinders at a minimum test pressure of 3500 psi (pounds per square inch). The inflation cylinders have a 15 year service life and contain carbon dioxide, nitrogen or air. For human safety, air is the preferred gas. Air also demonstrates less contraction than carbon dioxide in arctic temperatures.

Life raft canisters are stored on a ship deck to facilitate rapid deployment overboard in an emergency. It is statistically unlikely that a ship will sink during its useful life, and require evacuation to save lives. For safety awareness, the crew is periodically drilled to maintain their skills in handling a life raft. Likewise, the life raft canister is periodically opened and inspected to assure that the raft is in good working order and the inflation gas cylinder is up to standard operating pressure.

Life raft drills are carried out to reduce the inherent danger and inefficiency inherent in a real evacuation. Accordingly, a naval ship carries an excess of life raft capacity over the nominal crew size to accommodate damaged equipment and deviations in distribution and timing during evacuation. Life raft canisters are given priority in taking up deck space. Other essential equipment claims remaining deck space. As a result there is a conflict for the use of deck space between carrying on a ship's sailing and military functions and storage of emergency equipment.

SUMMARY OF THE INVENTION

A life raft launching apparatus is used in combination with a below-deck ship door, doorway and life raft canister. The life raft launching apparatus comprises the following:

(i.) A pneumatic actuator is positioned to move the door and expose the doorway to the sea.

(ii.) The life raft canister is positioned adjacent the doorway. A pneumatic ejection bladder is positioned between a support member and the life raft canister. The bladder is normally stowed in an uninflated, folded state. In the inflated state, the bladder extends to a length sufficient to eject the canister overboard through the doorway;

(iii.) An air supply is connected by way of an air supply valve to both the pneumatic actuator and the ejection bladder.

The life raft launching apparatus provides for below deck storage and launching of a life raft. The air supply is independent of the ship air supply and has a pressure sufficient to open a partially opened door and to launch a life raft in 20 seconds from a submerged compartment.

DETAILED DESCRIPTION OF THE INVENTION

Figure 1:
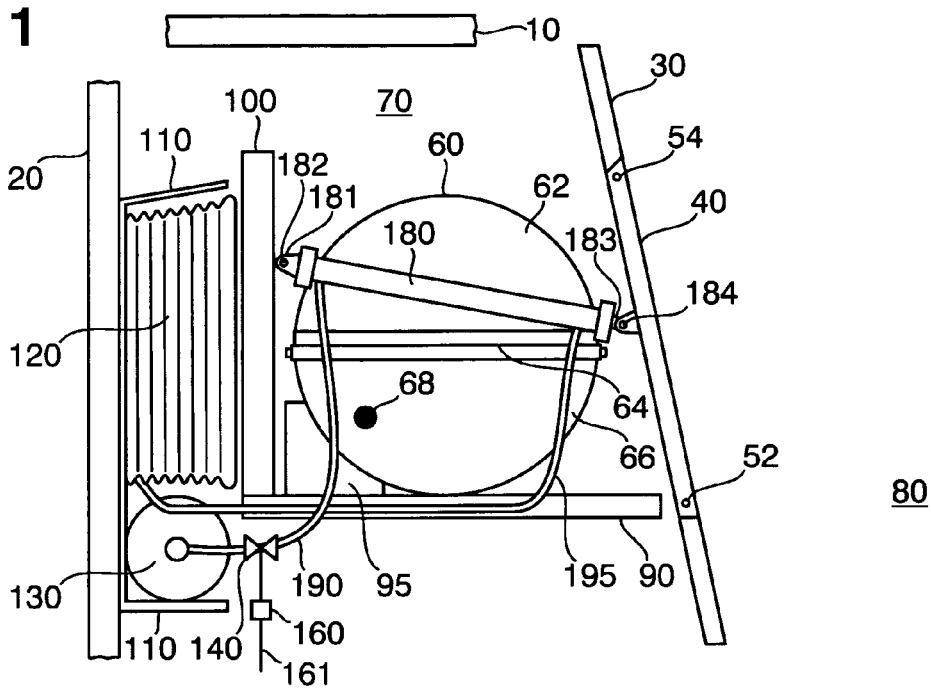
FIG. 1 is a side view of a life boat launcher with the door in the closed position.

The invention is described with reference to the drawing. The drawing discloses a preferred embodiment of the invention and is not intended to limit the generally broad scope of the invention as set forth in the claims. The drawing is schematic and is not drawn to scale.

Figure 2:
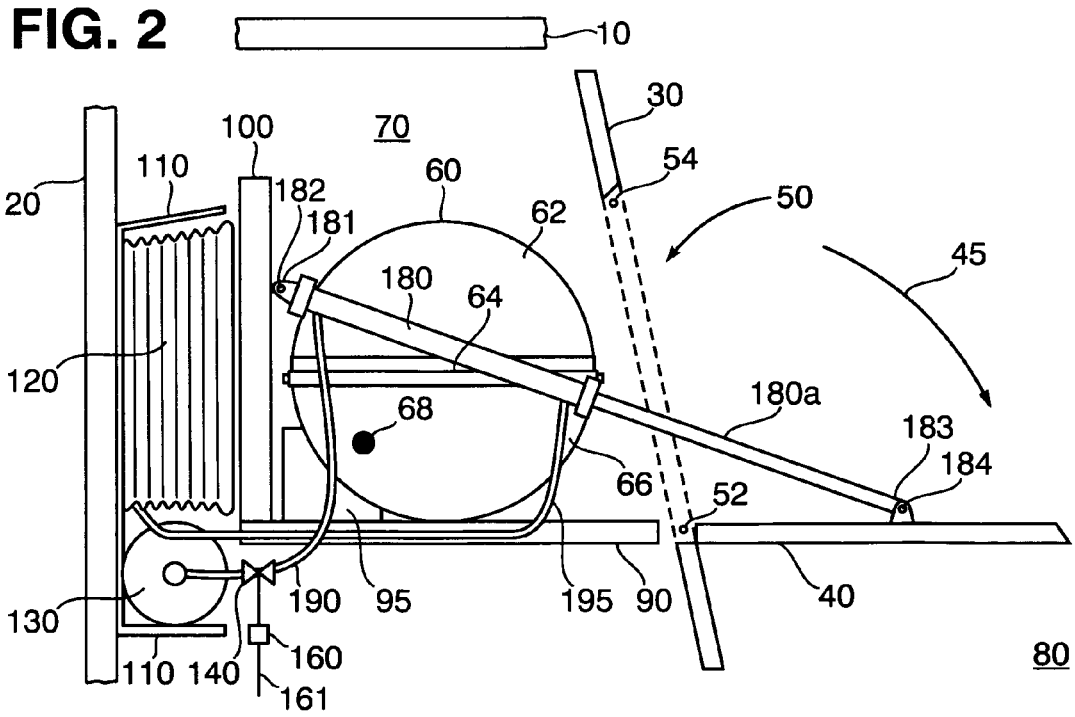
FIG. 2 is a side view of a life boat launcher with the door in the fully opened position.

In the drawing is shown a below-deck section of a ship indicated by main deck 10, bulkhead 20 and hull 30, all support members and integral with the ship. In FIG. 1, door 40 is in the closed position. In FIG. 2, door 40 is shown in the fully open position. The open door 40 in FIG. 2 opens doorway 50 which allows transport of life boat canister 60 from compartment 70 through doorway 50 to overboard 80 and the sea.

Hinge pins 52 and 54 are shown in doorway 50. The door 40 may optionally rotate on hinges (not shown). In FIG. 2, door 40 is hinged at the bottom and door 40 opens on hinge pin 52 outwardly and down. In a second alternative not shown, door 40 is hinged at the top and rotates on hinge pin 54 outwardly and up. In a third alternative not shown, door 40 has no hinges and on opening is jettisoned overboard 80 to the sea if not retained with a retaining strap (not shown). Fourth and fifth alternatives not shown, are for vertically mounted hinge pins (not shown) to facilitate opening door 40 to one side or the other.

Life raft canister 60 includes upper pod 62, lower pod 66 and seal 64 mating the two pods. Also shown is sea painter 68 which is connected to the life raft inflation system (not shown). When the sea painter 68 is pulled, life raft inflation valves (not shown) are actuated, inflating the life raft (not shown). The folded life raft is contained in life raft canister 60.

Life raft canister 60 is shown in FIG. 1 in a position directly adjacent door 40 and on opening of door 40 directly adjacent doorway 50. In this position, it is kept in position on cradle 90 with chock 95 and rigid frame 100. Chock 95 is made of a flexible material so that contact with bladder 120 during inflation will not cause a puncture. Bladder 130 is preferably made of polyurethane coated nylon fabric that is radio frequency welded. It is very abrasion and puncture resistant with strong, durable seams. This is the same material and means of construction as the life raft. The life raft canister, load with an Mk-8 life raft has a weight of 583 pounds (264 kilograms).

Ejection container 110 is shown in vertical orientation positioned in direct contact with bulkhead 20, a support member. Ejection container 110 contains a life raft ejection kit including pneumatic bladder 120, inflation cylinder 130, inflation valve 140, hydrostatic actuator 160 and air hoses. Ejection container 110 may include a redundant inflation cylinder 130. Ejection container 110 with contents can be removed by disconnecting electrical and pneumatic connection. The container is inspected and periodically replaced. Inspection includes inspecting the seams and materials of construction of bladder 130, measuring inflation gas pressure in inflation cylinder 130 and servicing inflation valve 140 and hydrostatic actuator 160. The kit has a 15 year service life based on the service life of the air cylinder.

Figure 3:
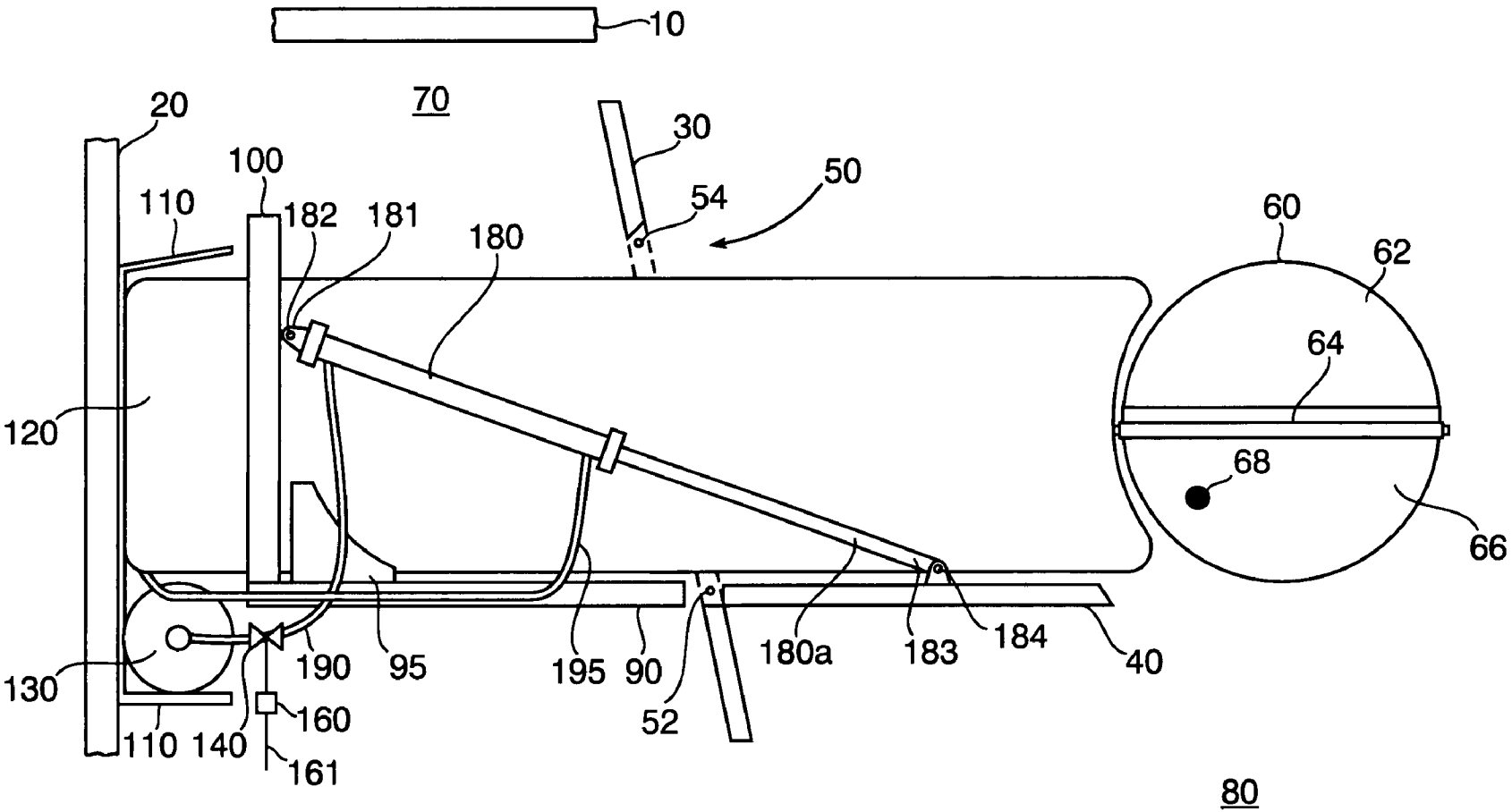
FIG. 3 is a side view of a life boat launcher with the door open and the elongated bladder fully extended.

Pneumatic bladder 130 is an elongated polyurethane coated nylon bladder. In FIGS. 1 and 2, pneumatic bladder 130 is shown in the uninflated and folded state, positioned between bulkhead 20 and life raft canister 60. Bladder 130 is not blocked by or otherwise contacted by cradle 90, chock 95 or rigid support frame 100 in the uninflated, stowed state or in the inflated and extended state shown in FIG. 3. As shown in FIG. 3, bladder is elongated and in the inflated, extended state has a length measured from bulkhead 20 that extends beyond hull 30, through doorway 50 to overboard 80. In the uninflated state, bladder 130 is folded to a size that fits in container 110 between bulkhead 20 and canister 60.

Gas inflation cylinder 130 is a U.S. Department of Transportation (DOT) approved, carbon fiber wrapped, aluminum composite air cylinder. It is typically similar to the gas inflation cylinder placed in canister 60 to inflate the life raft. The Mark 7 life raft uses a 550 cubic inch, 4500 psi inflation cylinder. The Mark 8 uses two 1636 cubic inch, 3500 psi inflation cylinders. Both sizes of inflation cylinder have a 15 year service life, the service life of ejection cassette 110. The ship air supply system is not used as the bladder inflation means. Ship air supply system could inflate the bladder; however, it would not have sufficient pressure to open the door, particularly a jammed or submerged door. It is recommended that the ship air supply system not be relied on, particularly during and emergency, to provide inflation gas and that the life boat launcher use a dedicated gas inflation means. For this purpose, the air cylinders used with the Mark 7 and Mark 8 life rafts are available in existing inventory.

Likewise it is preferred that valve 140 be the same model of inflation valve used with the Mark 7 and Mark 8 life rafts or the equivalent quick open air valve. One valve is commercially available from CIRCOR Aerospace—Aerodyne Controls, Inc., 30 Haynes Court, Ronkonkoma, N.Y. 11779-7229. The valve can be supplemented with control means 160. Control means 160 includes an initiation actuation signal 161 for deployment sent from a control panel in the control room on the bridge, a pressure transducer or a manually operated pull cable.

Pneumatically extendable arm includes the assembly sleeve 180 and extendable rod **180*a*. Extendable rod 180*a* is shown in FIG. 2 extending from sleeve 180. Pneumatically extendable arm is pivotably attached at a first (sleeve) end 181 to rigid frame 100 by a hinge, schematically indicated by hinge pin 182. In this drawing, rigid frame 100 is fixedly attached to cradle 90. The other, second end 183 of pneumatically extendable arm is pivotably attached to door 40. Attachment means is a hinge, shown schematically as hinge pin 184. It is essential that second end 183 make contact with door 40. It is not essential that second end 183 be attached to door 40. Hinge pin 184 cooperates with hinge pin 52 or hinge pin 54 to retain door 40 with the ship when door 40 is in the open position. It is clear that for hinge pin 184 to cooperate with hinge pin 52 or hinge pin 54, that hinge pin must be positioned parallel to them. In the alternative if it is intended to jettison door 40 overboard 80 after opening, hinge pin 184, hinge pin 52 and hinge pin 54** would all be absent.

It is clear by comparison of FIG. 1 and FIG. 2 that door 40 is moved from the closed position shown in FIG. 1 to the open position shown in FIG. 2. The opening of door 40 by rotation on hinge pin 52 to open is indication by arrow 45.

The motive force used to move the door is supplied by the gas in inflation cylinder 130. Air functions well for this purpose at temperatures in the range of −22° F. (−30° C.) to +160° F. (71° C.). Air does not change volume as much over the operating range as carbon dioxide does at low temperatures and provides no danger to humans should a leak occur.

Actuator 160 opens quick open valve 140 allowing air to pass from inflation tank 130 into hose 190. Hose 190 passes air to sleeve 180 of the pneumatically extendable arm. The air pressure in sleeve 180 forces extendable rod **180*a* out of sleeve 180, and fully extends the pneumatically extendable arm. As extendable rod 180*a* leaves sleeve 180, the evacuated space is filled with the high pressure air from hose 190**.

High pressure air flows through sleeve 180 to hose 195. Hose 195 passes air to bladder 120. Bladder 120 inflates with air. As a result it moves to the fully extended position. In FIG. 3, in the extended position, the elongated bladder 120 has a length sufficient to force canister 60 though doorway 50 and overboard 80. Once in the sea, the sea painter 68 is pulled, actuating the life raft inflation valve (not shown) to inflate the life raft (not shown). The inflation of the life raft forces canister 60 to open, allowing the life raft to deploy on the surface of the sea. A fully inflated life raft is thereby deployed from below-deck. The inflated Mk-8 life raft has a length of 21 feet 8 inches (6.6 meters), a beam of 17 feet 5 inches (5.3 meters) and a height of 8 feet 6 inches (2.6 meters).

Assembling hoses in series to pneumatically extendable arm and pneumatic bladder achieves time sequencing and is preferred. The hoses can be assembled in parallel to pneumatically extendable arm and pneumatic bladder. Such an arrangement would facilitate an equivalent arrangement such as a small extendable arm built into the door or door frame.

The life boat launcher will successfully launch at extreme ship attitudes and with ship motions. It is recommended that the inflation cylinder pressure be selected to provide launch under 5 to 15 feet of sea water should compartment 70 become flooded. For safety, it is preferred that the pressure be selected to provide launch at a depth of 15 feet of sea water or greater and also to provide sufficient pressure in the bladder to force open a partially opened or jammed door with bladder pressure. The launch depth limits of the invention are greater than the deployment depth limits of commercially available life rafts.

In the preferred embodiment, inflation cylinder 130 is either the Mark 7 type 4500 psi inflation cylinder or the Mark 8 type 3500 psi inflation cylinder in combination with the inflation valve type used with these life rafts. This combination achieves a life raft launch in 20 seconds from actuation. This is faster than presently know systems. It is preferred because the components are available in U.S. Navy inventory.

The invention is an improvement in an on deck launching system. There are no above board life raft canister, davits or other life raft launching apparatus. The ship deck is clear for other essential apparatus and use. As a result, the ship has a improved profile. In addition, the volume taken up by the life raft inflation kit including the uninflated and folded bladder is considerably less than that of some other apparatus. And in particular, the dimensions of an uninflated and folded bladder are less than that of an elongated piston or air jack apparatus and more conveniently contained in the confines of a ship.

The foregoing discussion discloses and describes embodiments of the invention by way of example. One skilled in the art will readily recognize from this discussion, that various changes, modifications and variations can be made therein without departing from the spirit and scope of the invention as defined in the following claims.

What is claimed is:

1. A life raft launching apparatus, in combination with a below-deck ship door, doorway and life raft canister positioned adjacent the doorway, the apparatus comprising:

(i.) a pneumatic actuator positioned to move the door thereby opening the doorway;

(ii.) a pneumatic ejection bladder positioned between a support member and the life raft canister and extendable between an uninflated, stowed position and an inflated, extended position and having a length in the extended position sufficient to eject the canister overboard through the doorway;

(iii.) an air supply valve and air supply connected in flow communication with both the pneumatic actuator and the ejection bladder.

2. The life raft launching apparatus of claim 1 wherein the air supply has a pressure sufficient to deliver air to the pneumatic actuator and the ejection bladder to open the door and eject the life raft canister at a resistance pressure of at least 15 feet of water.

3. The life raft launching apparatus of claim 1 wherein the air supply comprises an air tank and air hoses connected in series, supplying air: first to the pneumatic actuator and second to the ejection bladder.

4. The life raft launching apparatus of claim 1 wherein the life raft canister carries an inflatable life raft and inflation means.

5. The life raft launching apparatus of claim 1 wherein the air supply valve is manually actuatable.

6. The life raft launching apparatus of claim 1 wherein the air supply valve is actuatable on receipt of a signal.

7. The life raft launching apparatus of claim 1 wherein the air supply valve is hydrostatically actuatable.

8. The life raft launching apparatus of claim 1 wherein in the air supply, the air is breathable.

9. The life raft launching apparatus of claim 1 wherein in the pneumatic actuator includes a sleeve and extendable arm.

10. In combination with a below-deck ship hull door and doorway, a life raft launching apparatus comprising:

(i.) a pneumatically extendable arm connected to a first support member at a first end and the door at a second end and positioned to move the door from a closed position to an open position;

(ii.) a life raft canister positioned adjacent the doorway;

(iii.) an elongated pneumatic bladder positioned at one end adjacent a second support member and at a second end adjacent the life raft canister and extendable between an uninflated, retracted position and an inflated, extended position and having a length in the extended position sufficient to push the life raft canister overboard through the doorway;

(iv.) an air supply valve and air supply connected in fluid communication with both the pneumatically extendable arm and the elongated pneumatic bladder.

11. The life raft launching apparatus of claim 10 wherein the air supply comprises an air tank and air supply hoses.

12. The life raft launching apparatus of claim 10 wherein the air supply is an air tank and air supply hoses connected in parallel to the pneumatically extendable arm and the pneumatic bladder.

13. The life raft launching apparatus of claim 10 wherein the air supply is an air tank and air supply hoses connected in series: first, to the pneumatically extendable arm and second, to the pneumatic bladder.

14. The life raft launching apparatus of claim 10 wherein the air in the air supply is at a pressure of at least 15 feet of water.

15. The life raft launching apparatus of claim 10 wherein the air in the air supply is at a pressure of at least 3000 pounds per square inch.

16. The life raft launching apparatus of claim 10 wherein the life raft canister contains an inflatable life raft and inflation means.

17. The life raft launching apparatus of claim 10 wherein the air supply valve is manually actuatable.

18. The life raft launching apparatus of claim 10 wherein the air supply valve is actuatable by means of a signal.

19. The life raft launching apparatus of claim 10 wherein the air supply valve is hydrostatically actuatable.

20. The life raft launching apparatus of claim 10 wherein the pneumatically extendable arm includes a pneumatic cylinder.

* * * * *